United States Patent [19]

Ahlborn et al.

[11] Patent Number: 4,901,040

[45] Date of Patent: Feb. 13, 1990

[54] REDUCED-HEIGHT WAVEGUIDE-TO-MICROSTRIP TRANSITION

[75] Inventors: William G. Ahlborn, Somerville; Harry F. Lenzing, Atlantic Highlands; You-Sun Wu, Princeton Junction, all of N.J.

[73] Assignees: American Telephone and Telegraph Company, New York, N.Y.; AT&T Bell Laboratories, Murray Hill, N.J.

[21] Appl. No.: 331,770

[22] Filed: Apr. 3, 1989

[51] Int. Cl.[4] ..... H01P 5/107

[52] U.S. Cl. ..... 333/26; 333/246; 333/254

[58] Field of Search ..... 333/21 R, 26, 33, 238, 333/246

[56] References Cited

U.S. PATENT DOCUMENTS

| | | | |
|---|---|---|---|
| 2,829,348 | 4/1958 | Kostriza et al. | 333/26 |
| 3,462,713 | 8/1969 | Knerr | 333/238 X |
| 3,518,579 | 6/1970 | Hoffman | 333/21 R |
| 3,732,508 | 5/1973 | Ito et al. | 333/21 R |
| 4,052,683 | 10/1977 | van Heuven et al. | 333/21 R |
| 4,260,964 | 4/1981 | Saul | 333/26 |
| 4,453,142 | 6/1984 | Murphy | 333/26 |
| 4,550,296 | 10/1985 | Ehrlinger et al. | 333/26 |
| 4,689,631 | 8/1987 | Gans et al. | 343/781 R |
| 4,800,393 | 1/1989 | Edward et al. | 343/821 |

FOREIGN PATENT DOCUMENTS

| | | | |
|---|---|---|---|
| 2402 | 1/1984 | Japan | 333/26 |

OTHER PUBLICATIONS van Heuven, *IEEE Trans. Microwave Theory & Tech.*, vol. MTT-24, No. 3, Mar. 1976, pp. 144–147.

Smith, *Communications International (GB)*, vol. 6, No. 7, Jul. 1979, pp. 22, 25, 26.

Bharj et al., *Microwaves and RF*, vol. 23, No. 1, Jan. 1984, pp. 99–100, 134.

Jackson et al., *IEEE Trans. Antennas & Propagation*, vol. AP-34, No. 12, Dec. 1986, pp. 1430–1438.

Kominami et al., *Electron. & Comm. in Japan*, Pt. 1, vol. 71, No. 7, 1988, pp. 100–110.

*Primary Examiner*—Paul Gensler

*Attorney, Agent, or Firm*—Erwin W. Pfeifle

[57] ABSTRACT

The present invention relates to a transition wherein a microstrip line, formed on one major surface of a substrate, is capacitively coupled to a reduced-height waveguide, comprising a predetermined width-to-height ratio, by means of a T-bar conductive pattern formed on a substrate at the end of the microstrip line. Such T-bar transitions can also be connected on opposite end of the microstrip line to provide connections between two waveguide sections.

7 Claims, 4 Drawing Sheets

REDUCED-HEIGHT WAVEGUIDE-TO-MICROSTRIP TRANSITION

TECHNICAL FIELD

The present invention relates to a reduced-height waveguide-to-microstrip transition, where the microstrip is capacitively coupled to a waveguide, which includes a predetermined width-to-height ratio, by means of a T-bar conductive pattern formed on one side of a substrate.

DESCRIPTION OF THE PRIOR ART

Standard waveguide-to-microstrip transitions have been developed as shown, for example in U.S. Pat. Nos. 3,518,579 issued to M. Hoffman on June 30, 1970; 4,052,683 issued to J. H. C. van Heuven et al. on October 4, 1977; 4,453,142 issued to E.R. Murphy on June 5, 1984; and the article by E. Smith et al. in *Communications International,* Vol. 6, No. 7, July 1979 at pages 22, 25 and 26. However, all of these transitions are used for connecting full-height waveguide to either microstrip or coaxial-line terminals. In certain applications, such as phased-array systems, where thousands of waveguide horns are packed together, reduced-height waveguides are generally selected for small size and reduced weight. An example of the use of reduced-height waveguides in an array is disclosed, for example, in U.S. Pat. No 4,689,631 issued to M. J. Gans et al. on August 25, 1987, where a space amplifier arrangement is disposed in the aperture of an antenna. The space amplifier comprises a waveguide array where full-sized waveguide input and output waveguide sections are each reduced, via an impedance matching configuration, to a reduced-height waveguide section into which a separate portion of a microstrip amplifier arrangement is extended.

The problem with providing microstrip-to-reduced height waveguide transitions is that the transition should extend into the reduced-height waveguide section by a distance equal to approximately one-quarter wavelength of the signal to be intercepted or transmitted by the transition. While the one-quarter wavelength distance is available with standard full-size waveguides, the reduced-height waveguides do not provide such distance between the more closely spaced opposing broadwalls of the waveguide. As a result, if the known transitions normally used with full-sized waveguides were extended through one of such closely-spaced opposing walls of the reduced-height waveguide, such transition would be shorted out by the opposing waveguide wall of such reduced-height waveguide. Therefore, the problem remaining in the prior art is to provide a microstrip-to-reduced height waveguide transition that provides the necessary one-quarter wavelength distance for insertion between the opposing closely-spaced walls of a reduced-height waveguide section without being shorted while being capable of efficient transfer of signals between the microstrip and the reduced-height waveguide section

SUMMARY OF THE INVENTION

The foregoing problem in the prior art has been solved in accordance with the present invention which relates to a microstrip-to-reduced height waveguide transition comprising the configuration of a T-bar conductive pattern on one major surface of the microstrip. The T-bar pattern permits approximately a quarter wavelength distance to be provided when measured along both the body and an extended arm of the "T" pattern without the pattern being shorted to a wall of the reduced-height waveguide section when such pattern is extended through an aperture in the wall of the reduced-height waveguide. Such transitions can also be used for reduced height waveguide-microstrip-waveguide transitions comprising the form of a cascaded double-T-bar transition on the microstrip substrate.

Other and further aspects of the present invention will become apparent during the course of the following description and by reference to the accompanying drawings.

DETAILED DESCRIPTION

Figure 2:
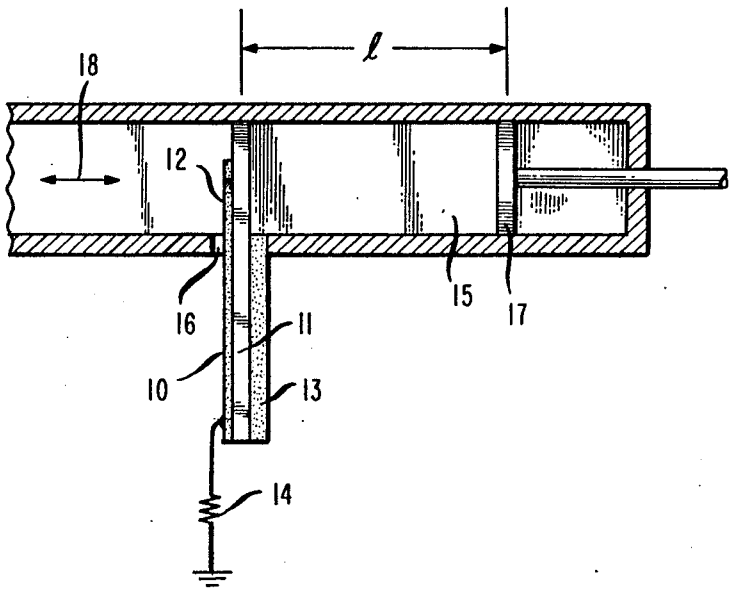
FIG. 2 is a side view of the exemplary structure of FIG. 1.
Figure 1:
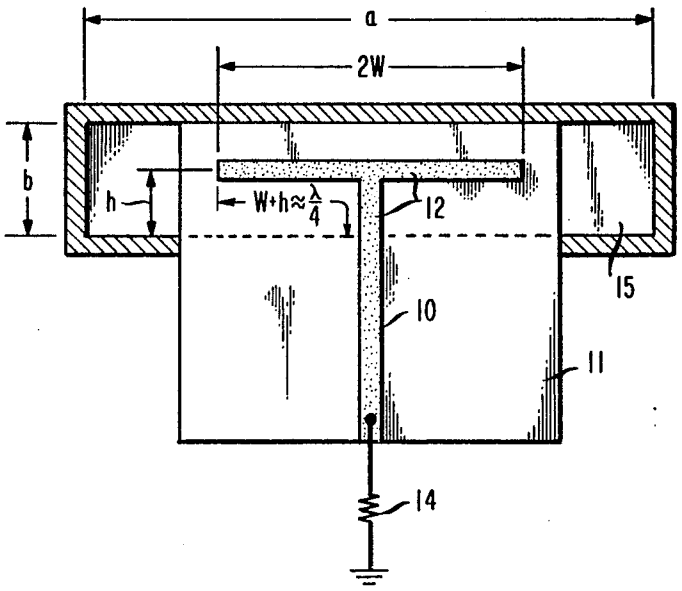
FIG. 1 is a front view of an exemplary structure of a T-Bar transition disposed on a major surface of a microstrip in accordance with the present invention as disposed inside a rectangular reduced-height waveguide.

FIGS. 1 and 2 show a front and side view, respectively, of the structure of a conductive microstrip line 10 terminating in a conductive T-bar antenna transition pattern 12, with a width "2W", which is formed on a first major surface of a substrate 11, which substrate can comprise any suitable material as, for example, alumina. The T-bar transition 12 is used to connect the microstrip transmission line 10, which is terminated in a load 14, to a reduced-height waveguide section 15 which comprises a width "a" and a height "b". For exemplary purposes only, it will be considered hereinafter that microstrip line 10 has a width of 0.062 inches, but it should be understood that any other suitable line width can be used. Additionally, a conductive ground plane 13 is formed on a second major surface of substrate 11 opposite the first major surface of substrate 11 such that the ground plane does not extend into the area opposite T-bar transition 12. As shown in FIGS. 1 and 2, substrate 11 is inserted through an aperture 16 in a wall of reduced-height waveguide section 15 so that the central conductor forming the leg of T-bar transition 12 extends a predetermined distance "h" into waveguide 15.

As shown in the side view of FIG. 2, when substrate 11 is disposed in aperture 16 of reduced-heght waveguide section 15, ground plane 13 is coupled to the wall of waveguide 15 by any suitable means such as, for example, by contact, while the T-bar transition extends through aperture 16 of waveguide section 15 without cotact with a wall of the waveguide section. It should be understood that ground plane 13 does not overlap the opposing area to T-bar transition 12 when disposed within waveguide section 15 so that electromagnetic signals 18 propagating towards T-bar transition 12, or emanating from the T-bar transition, are permitted to pass through substrate 11. A sliding short 17 is disposed at a distance "l" behind the T-bar antenna transition 12 to tune out the antenna 12 reactance and avoid reflections as is well known in the art.

Figure 6:
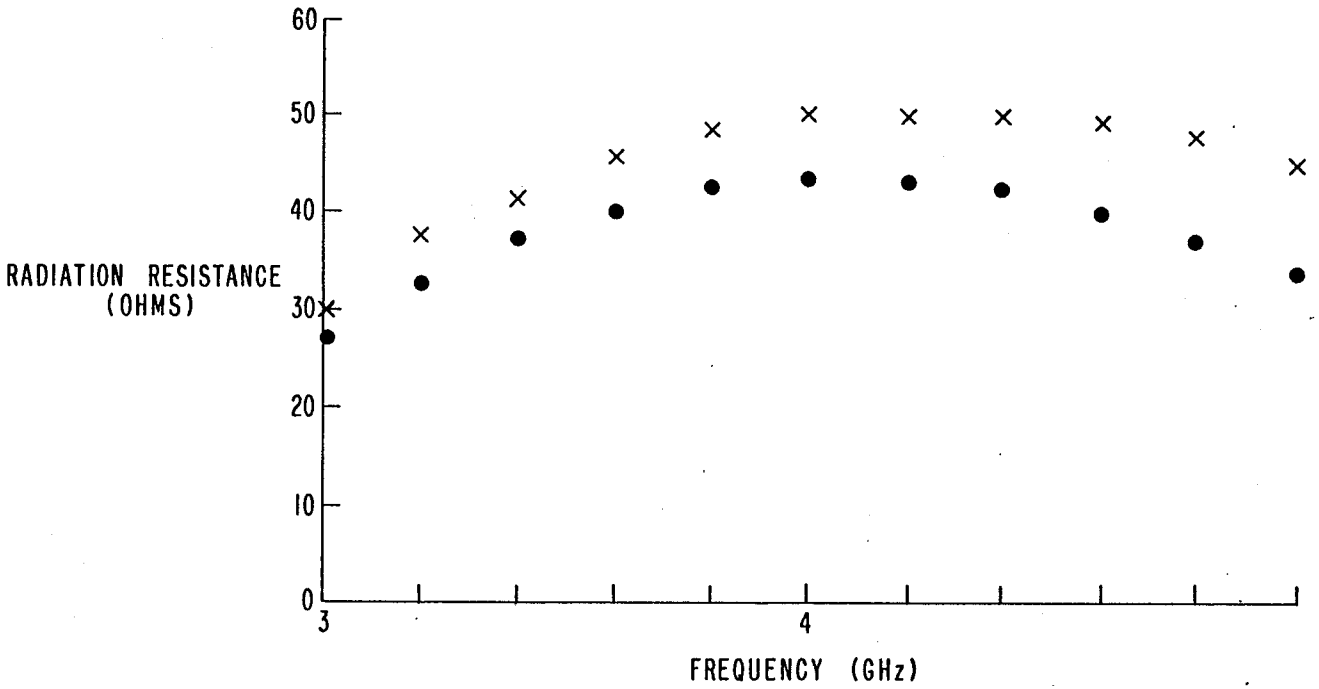
FIG. 6 is a graph of radiation resistance vs. frequency for a particularly dimensioned T-Bar transition of FIG. 1 when the transition is disposed inside a particularly dimensioned reduced-height waveguide.

Radiation resistance is defined in communication dictionaries as the electrical resistance that, if inserted in place of an antenna, would consume the same amount of power that is radiated by the antenna; or the ratio of the power radiated by the antenna to the square of the rms antenna current referred to a specified point. It is known that the radiation resistance of an open-ended probe antenna inside a waveguide for a predetermined wavelength is dependent on the free space impedance, the propagation constant of a particular TE mode (e.g., the $TE_{10}$ mode), the propagation constant of free space, the backshort distance "l", and the width "a" and height "b" of the waveguide. FIG. 6 shows a graph of exemplary values for the radiation resistance of a first and a second T-bar antenna transition 12 disposed inside a standard WR-229 reduced-height waveguide section 15 versus frequency.

For an exemplary first T-bar antenna transition, having a half-width W=0.500 inches and a height h=0.150 inches disposed in a WR-229 reduced-height waveguide section 15 having a width a=2.29 inches and a height b=0.200 inches, the exemplary values of the radiation resistance for various frequencies are shown by the "circles" in FIG. 6. It should be noted that the radiation resistance for the first T-bar transition is 43.5 ohms at 4.0 GHz. FIG. 6 also shows exemplary values of the radiation resistance for a second T-bar antenna transition 12 having a half-width W=0.700 inches and a height h=0.150 inches disposed inside a WR-229 reduced-height waveguide section 15, which exemplary radiation resistance values are indicated with "X"s for the various frequencies. It should be noted that at 4.0 GHz the radiation resistance of the second T-bar antenna transition equals 50 ohms. Therefore, it can be seen that by increasing the half-width (W) of the T-bar antenna transition from 0.50 inches, for the first T-bar transition, to 0.70 inches, for the second T-bar transition, the radiation resistance was increased from 43.5 ohms to 50 ohms. Such change in radiation resistance illustrates that there is a trade-off between the T-bar transition width (2W) versus its height (h), and that a short T-bar transition can still work if its width is increased. Additionally, it should be understood that by adjusting the T-bar transition 12 width and height, a good transition between a microstrip line 10 and a reduced-height waveguide 15 can be designed. For comparison, the waveguide impedance for a WR-229 reduced-height waveguide, at 4 GHz, is found to equal 69 ohms which is comparable to the radiation resistance of the second T-bar antenna transition above.

Figure 4:
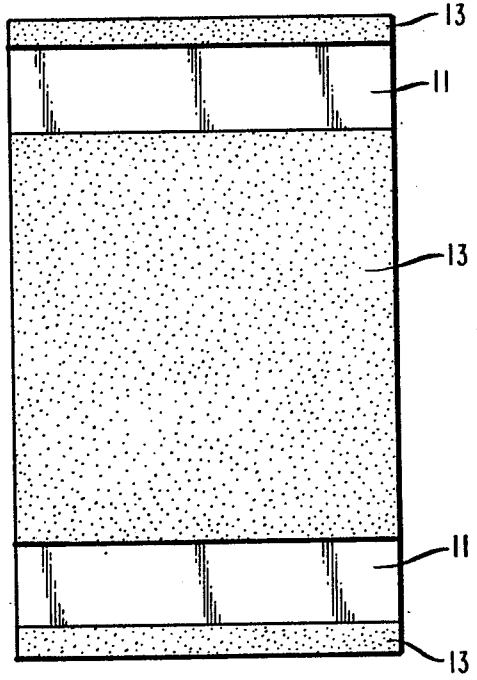
FIG. 4 is a rear view of the exemplary microstrip ground plane metalization for the exemplary transition of FIG. 3.
Figure 3:
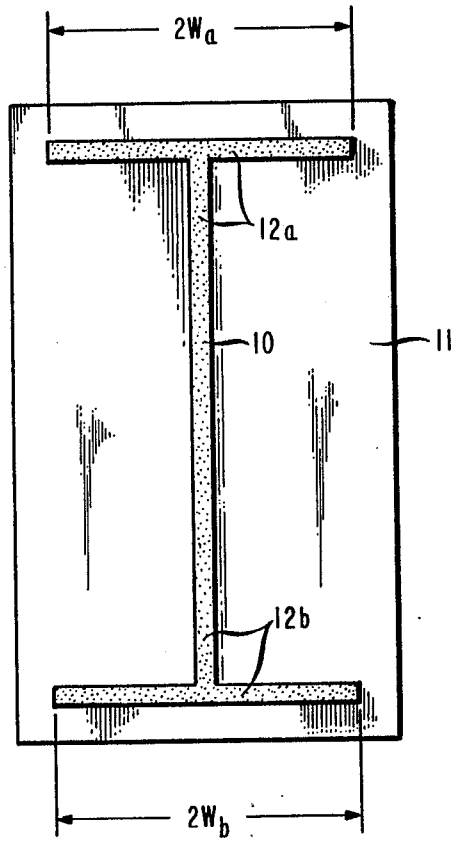
FIG. 3 is a front view of an exemplary microstrip metallization for a waveguide-microstrip-waveguide transition in accordance with the present invention.

The present T-bar antenna transition can also be used to provide a waveguide-microstrip-waveguide transition by cascading two of the T-bar transitions of FIG. 1 in the manner shown in FIG. 3. More particularly, in the front view of FIG. 3, a first T-bar antenna transition $\mathbf{12}_a$ is directly connected to a second T-bar antenna transition $\mathbf{12}_b$ via microstrip line 10 on a substrate 11. This type of transition can be used, for example, for connecting hybrid and monolithic high-speed circuits to reduced-height waveguide input and output ports. For such use, the first T-bar transition $\mathbf{12}_a$ couples microwave energy to or from a first waveguide section and the second T-bar transition $\mathbf{12}_b$ couples microwave energy from or to a second waveguide section. The back view of such waveguide-microstrip-waveguide transition is shown in FIG. 4 and includes an exemplary metalized backplane 13 configuration on substrate 11. As stated hereinbefore, the metallization of the backplane is omitted from the area opposite the T-bar antenna transitions $\mathbf{12}_a$ and $\mathbf{12}_b$ to permit electromagnetic waves to impinge the transitions from either side of the substrate 11.

Figure 5:
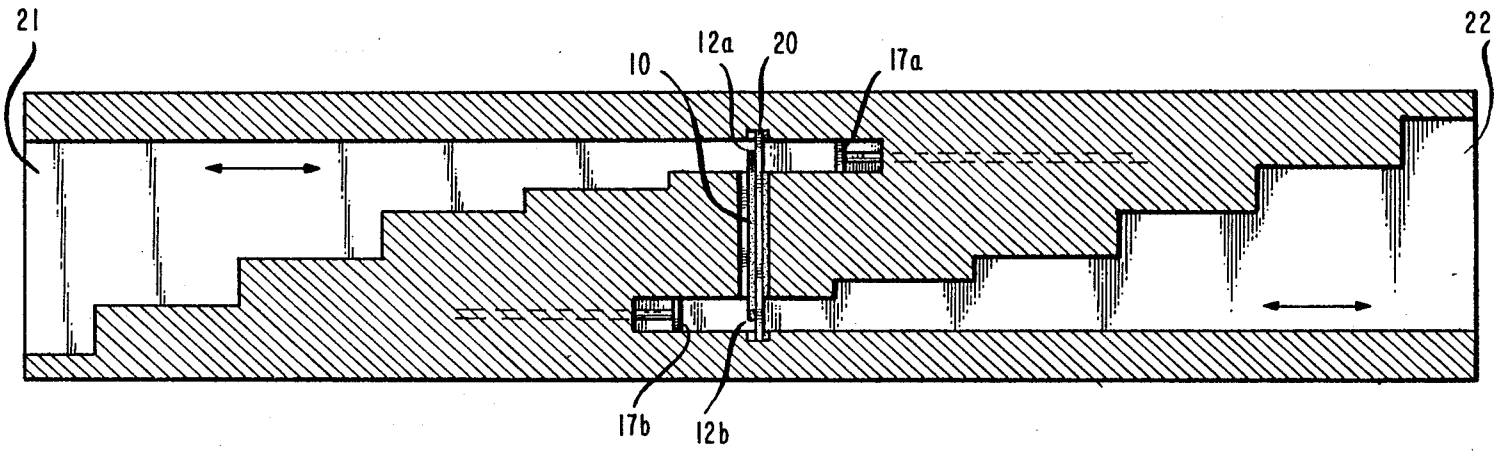
FIG. 5 is a side view of a waveguide-microstrip-waveguide transition of FIG. 2 as disposed between two reduced-height waveguide sections.

FIG. 5 illustrates a cross-sectional view of a broadband waveguide-microstrip-waveguide transition 20, of the type shown in FIG. 3, disposed between two waveguide sections 21 and 22. Waveguide sections 21 and 22 are each reduced in height in predetermined steps when traveling from its associated entrance port to the transition 20 area to provide, for example, appropriate impedance matching. In FIG. 5, waveguide 21 is reduced to, for example, a WR-229 reduced-height waveguide section in the area of transition 20 so that electromagnetic signals propagating towards transition 20 are intercepted by T-bar antenna transition $\mathbf{12}_a$. Any signal passing through the area of T-bar transition $\mathbf{12}_a$ in back of substrate 11 will be intercepted by backshort $\mathbf{17}_a$ to tune out any reactance and avoid reflected signals back to transition $\mathbf{12}_a$. A similar arrangement is provided for waveguide 22 and T-bar antenna transition $\mathbf{12}_b$. Therefore, any signal propagating from the entrance port of waveguide 21 will be intercepted by T-bar antenna transition $\mathbf{12}_a$ and be transmitted via microstrip line 10 to T-bar antenna transition $\mathbf{12}_b$ for launching into waveguide 22 for propagation towards its entrance port. A signal entering the entrance port for waveguide 22 would similarly be propagated to the entrance port of waveguide 21 via waveguide-microstrip-waveguide transition 20.

It should be noted that for the arrangement of FIG. 5, the waveguide-microstrip-waveguide transition is disposed on the side of substrate 11 facing the entrance port of waveguide 21. In the arrangement of FIG. 3, it should be noted that the top transition $\mathbf{12}_a$ has a width indicated as $2W_a$ and lower transition $\mathbf{12}_b$ has a width indicated as $2W_b$. When the transition of FIG. 3 is used in the arrangement of FIG. 5, the width of transition $\mathbf{12}_a$ would be wider that the width of transition $\mathbf{12}_b$ in order to compensate for the difference in the sliding short $\mathbf{17}_a$ and $\mathbf{17}_b$ location. More particularly, the T-bar of transition $\mathbf{12}_a$ is disposed on the reverse side of substrate 11 relative to associated sliding short $\mathbf{17}_a$, while the T-bar of transition $\mathbf{12}_b$ is disposed facing its associated sliding short $\mathbf{17}_b$.

It is to be understood that it is possible to modify the width and/or height of the first and second T-bar configurations to provide a desired radiation resistance result where possible.

It should be understood that the above-described embodiments are simply illustrative of the principles of the invention. Various other modifications and changes may be made by those skilled in the art which will embody the principles of the invention and fall within the spirit and scope thereof.

We claim:

1. A waveguide transition comprising:

a reduced-height waveguide section for propagating electromagnetic signals in at least one predetermined frequency band; and a microstrip transition for insertion through an aperture in the reduced-height waveguide section in a transverse plane of the reduced-height waveguide section, and for transmitting or receiving the electromagnetic signals propagating in the reduced-height waveguide section, the microstrip transition comprising, a substrate formed from a non-conductive material comprising a first and a second opposing major surface, a conductive layer formed on the first major surface of the substrate comprising a T-bar configuration, where the arms of the T-bar configuration are disposed parallel to and near a first end of the substrate that is inserted into the reduced-height waveguide section to provide a predetermined capacitance component with the nearest wall of the reduced-height waveguide section, and the body of the T-bar configuration emanating from only one side of the arms extends a predetermined distance within the reduced-height waveguide section to provide a predetermined inductance component, and a ground plane conductive layer formed on the second major surface of the substrate, the ground plane layer being excluded from at least the area opposite the T-bar configuration.

2. A waveguide transition according to claim 1 wherein the T-bar configuration includes a width and a height that approximates a one-quarter wavelength of a signal to be transmitted to or received from the reduced-height waveguide section by the transition, where the width and height are defined as a distance along an extended arm and the body, respectively, of the T-bar when inserted in the reduced-height waveguide section.

3. A waveguide transition according to claim 2 wherein the width and height are adjusted to provide a predetermined radiation resistance relative to a predetermined frequency band when the T-bar configuration is disposed within the waveguide section.

4. A waveguide transition according to claim 1, 2 or 3 wherein the T-bar configuration is disposed on the first major surface of the substrate to not make contact with a wall of the reduced-height waveguide section when the T-bar configuration is disposed through the aperture and within the reduced-height waveguide section; and the conductive ground plane is disposed on the second major surface of the substrate to make contact with at least one waveguide wall when the T-bar configuration is disposed through the aperture and within the reduced-height waveguide section.

5. A waveguide transition according to claim 1, 2 or 3 whrein the waveguide transition comprises a second reduced-height waveguide section disposed near the first reduced-height waveguide section, and the conductive layer formed on the first major surface of the substrate comprises a second T-bar configuration which is disposed near, but not in contact with, a second end of the substrate opposite the first end of the first major surface for forming a second waveguide-to-microstrip transition when the second T-bar configuration is disposed through an aperture in, and in a transverse plane of, the second reduced-height waveguide section, the bodies of the first and second T-bar configurations being coupled together either directly or through a circuit.

6. A waveguide transition according to claim 5 wherein the height and/or width of the first and the second configurations are different and each transition includes a width and height that approximates a one-quarter wavelength of a signal propagating in the associated reduced-height waveguide section, where the width and height are defined as a distance along an arm and a body, respectively, of the T-bar configuration when inserted in the associated reduced-height waveguide section.

7. A waveguide transition accoding to claim 6 wherein each of the first and second T-bar configurations has a width and a height to provide a predetermined radiation resistance in a predetermined frequency band when the first and second T-bar configurations are inserted into the first and second reduced-height waveguide sections, respectively.

* * * * *